US005937235A

United States Patent [19]

Huss et al.

[11] Patent Number: 5,937,235

[45] Date of Patent: Aug. 10, 1999

[54] REPRODUCTION MACHINE INCLUDING A DEVELOPER MATERIAL CARTRIDGE HAVING A NON-INTERFERING DUAL-USE SEALING DEVICE

[75] Inventors: Timothy L. Huss, Ontario; Paul M. Wegman, Pittsford, both of N.Y.

[73] Assignee: Xerox Corporation, Stamford, Conn.

[21] Appl. No.: 09/126,159

[22] Filed: Jul. 30, 1998

[51] Int. Cl.[6] ..... G03G 15/08

[52] U.S. Cl. ..... 399/102; 215/232; 220/361; 399/120; 399/360

[58] Field of Search ..... 399/102, 119, 399/120, 358, 360; 215/232; 220/269, 359, 361

[56] References Cited

U.S. PATENT DOCUMENTS

| | | | |
|---|---|---|---|
| 5,080,745 | 1/1992 | Paull | 399/102 |
| 5,428,436 | 6/1995 | Sundquist et al. | 399/360 |
| 5,495,323 | 2/1996 | Meetze, Jr. | 399/120 |

*Primary Examiner*—William Royer
*Assistant Examiner*—William A. Noe
*Attorney, Agent, or Firm*—Tallam I. Ngutt

[57] ABSTRACT

An electrostatographic reproduction machine including a movable photoconductive member having an image bearing surface; devices for forming a latent image electrostatically on the image bearing surface; a developing assembly including toner particles for developing the latent image to be transferred onto a sheet; a moving device for moving waste toner particles from the image bearing surface and from the developing assembly; a toner particle cartridge having a waste toner receiving opening for receiving waste toner particles from the moving device; and a non-interfering dual-use cartridge sealing device for accessibly presealing the receiving opening for receiving waste toner particles, and for effectively resealing the receiving opening during shipping of the toner cartridge to a recycling location. The non-interfering dual-use cartridge sealing device includes a flexible substrate having a first portion and a second portion where the first portion has a resilient member mounted to the flexible substrate, slits formed through the resilient member and through the flexible substrate in the first portion, and a device for attaching the first portion over the receiving opening. The second portion is long enough and foldable over the resilient member, and has a device for effectively attaching and sealing the second portion to the resilient member, thus effectively resealing the slits over the receiving opening against waste toner particle spillage during shipping of the toner cartridge to a recycling location.

11 Claims, 6 Drawing Sheets

REPRODUCTION MACHINE INCLUDING A DEVELOPER MATERIAL CARTRIDGE HAVING A NON-INTERFERING DUAL-USE SEALING DEVICE

RELATED APPLICATION

This application is related to U.S. application Ser. No. 09/124,788 entitled "REPRODUCTION MACHINE INCLUDING A DEVELOPER MATERIAL CARTRIDGE HAVING A LABEL ASSEMBLY REUSEABLE AS A SEALING DEVICE" filed on even date herewith, and having at least one common inventor.

BACKGROUND

This invention relates to electrostatographic reproduction machines, and more particularly to such a machine including a developer material cartridge having a non-interfering dual-use cartridge sealing device.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer material is commonly used. A typical two-component dry developer material has magnetic carrier granules with fusible toner material adhering triobelectrically thereto. A single component dry developer material typically comprising toner material only can also be used. The toner image formed by such development is subsequently transferred at a transfer station onto a copy sheet fed to such transfer station, and on which the toner material image is then heated and permanently fused so as to form a "hardcopy" of the original image.

One familiar type of development of an electrostatic image is called "two-component development" because it utilizes two-component developer. Two-component developer largely comprises toner material interspersed with carrier material The carrier material is magnetically attractable, and the toner material is, caused to adhere triboelectrically to the carrier material. This two-component developer can be conveyed, by means such as a "magnetic roll," to the electrostatic latent image, where toner material becomes detached from the carrier material and adhere as desired to the electrostatic latent image.

Development of the electrostatic image with developer material results in the generation of waste developer material which is removed and stored in a waste sump disposed within the electrostatographic reproduction machine. A waste sump is designed with one or more openings which allow an auger to deposit waste developer material inside the sump. When full, the waste sump is removed from the electrostatographic reproduction machine. Prior to removal of the waste sump, the openings of the waste sump need to be sealed to minimize spillage of the waste developer material. As disclosed for example in U.S. Pat. No. 5,428, 436, it is known to provide a waste sump seal member which attempts to prevent or minimize waste developer particle spillage during removal of the waste sump from the machine. Such a waste sump seal member does so by automatically attempting to seal or reclose a waste sump opening immediately upon withdrawal of a waste toner developer material delivery auger from the waste sump opening.

Typically, the seal member for the waste sump opening as disclosed, is slotted and designed mainly to keep the waste toner from leaking during waste toner delivery into the waste sump. However, it has been found that the slotted seal member leaks toner during harsh shipping movements of the removed waste sump to a distant location for recycling purposes. Consequently, the customer or operator must place the waste sump after removal from the machine, into a bag prior to such shipment. The bags and bagging operation required for this are of course costly and time consuming.

Further, it has been found that such repackaging or bagging is not adequate to prevent waste toner or developer material from spilling out of the waste sump through the slits and into the bag or container, and thus making a mess all over the bagged cartridge or waste sump. The bags, the spilled waste toner and the mess on the sump of course further complicate handling and recycling efforts.

There is therefore a need for a sealing device which automatically preseals or closes a waste sump opening immediately upon withdrawal of the waste auger so that the sump can be moved within and removed from the machine without spilling much of the waste developer material. There is also a need for a sealing device which is easy to use, and which can further seal the waste sump opening against waste developer material spillage even during harsh shipping movements to distant locations for recycling.

SUMMARY OF THE INVENTION

In accordance with the present invention, there is provided an electrostatographic reproduction machine including a movable photoconductive member having an image bearing surface; means for forming a latent image electrostatically on the image bearing surface; developing means including toner particles for developing the latent image to be transferred onto a sheet; moving means for moving waste toner particles from the image bearing surface and from the developing means; a toner particle cartridge having a waste toner receiving opening for receiving waste toner particles from the moving means; and a non-interfering dual-use cartridge sealing device for accessibly presealing the receiving opening for receiving waste toner particles, and for effectively resealing the receiving opening during shipping of the toner cartridge to a recycling location. The non-interfering dual-use cartridge sealing device includes a flexible substrate having a first portion and a second portion. The first portion has a resilient member mounted to the flexible substrate, slits formed through the resilient member and the flexible substrate in the first portion, and means for attaching the first portion over the receiving opening. The second portion is long enough and foldable over the resilient member, and has means for effectively attaching and sealing the second portion to the resilient member, thus effectively resealing the slits over the receiving opening against waste toner particle spillage during shipping of the toner cartridge to a recycling location.

In accordance with another aspect of the present invention, there is provided a dual function sealing device that is suitable in general for effectively and accessibly sealing a particulate material receiving opening of a container during a particulate material receiving function of the container. It is also suitable for further resealing the accessibly-sealed opening during shipping of the container. The dual function sealing device includes an elongate substrate having a first side, a second side, a first end for mounting over the particulate material receiving opening of the container to provide an accessible seal, and a second end for foldably mounting over the first end for the resealing function as above. The dual function device also includes a first adhesive layer that is applied to the second side at only the first end of the elongate substrate, for adhering and mounting the second side of the first end, and over the particulate or toner material receiving opening. A resilient member, having a top side and a bottom side, is attached to the first side of the first end so as to be directly over the particulate material receiving opening when the sealing device is mounted over the opening. The resilient member, and the first end of the elongate substrate, each include multiple, centered and crossing slits that are formed therethrough, from the top side of the resilient member through to the second side of the first end. The slits are suitable for enabling access by a waste particulate material delivery auger through the resilient member, through substrate and the opening into the chamber. The slits enable receiving of a particulate material delivery device such as the delivery auger into the opening, and yet also enables sealing against the auger and against particulate material leakage during particulate material delivery and receiving into the chamber. Importantly, the dual function sealing device includes a second adhesive layer that is applied to the first side at the second end of the elongate substrate. As applied, the second adhesive layer makes the first side of the second end suitable for adhering and mounting onto the top side of the resilient member, hence sealing the slits over the opening, and thus preventing particulate material leakage during shipping of the container.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
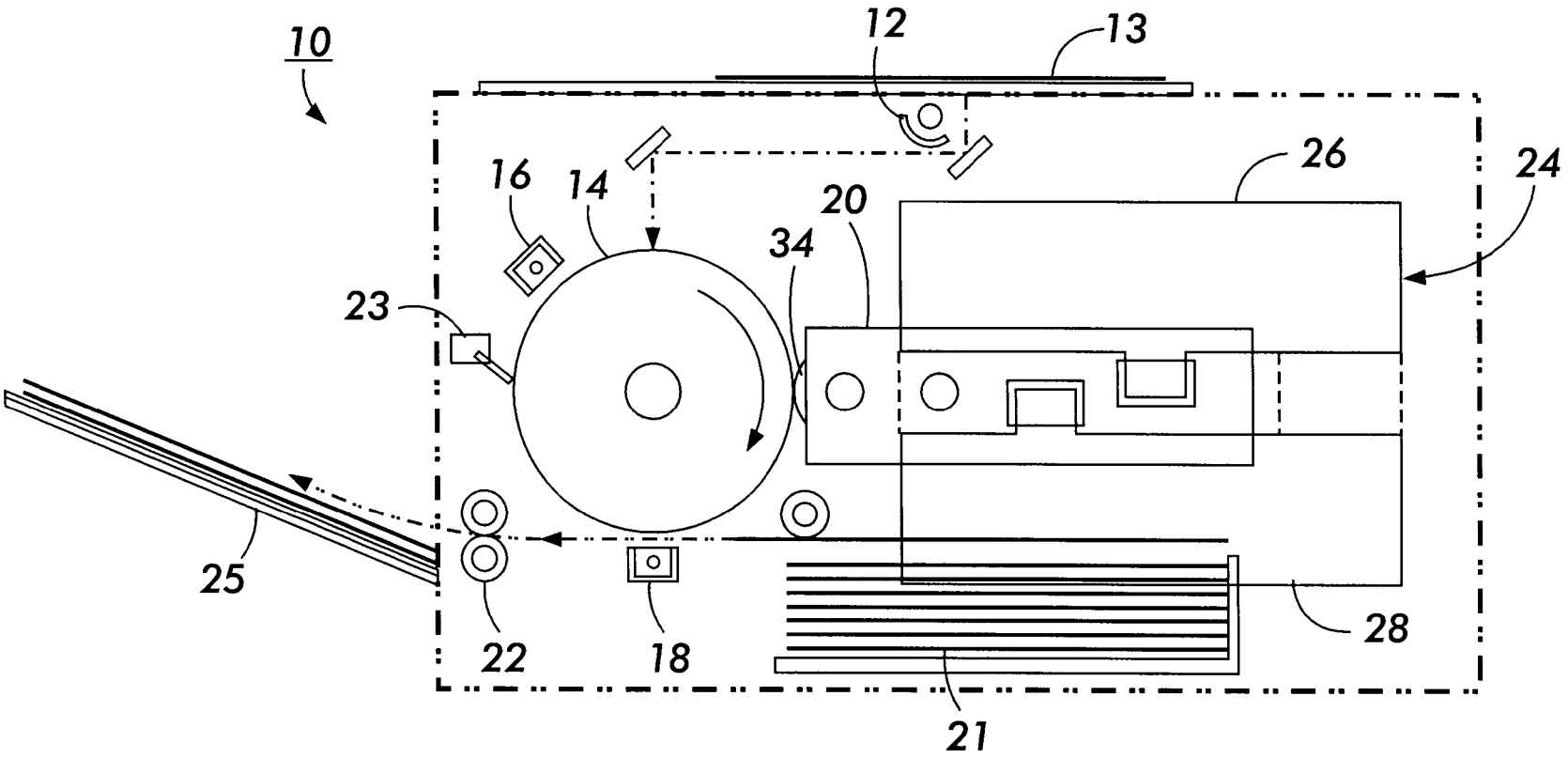
FIG. 1 is a schematic, side view showing the elements of an electrostatographic reproduction machine, in this case a copier, including the developer material cartridge having the non-interfering dual-use cartridge sealing device according to the present invention.
Figure 2:
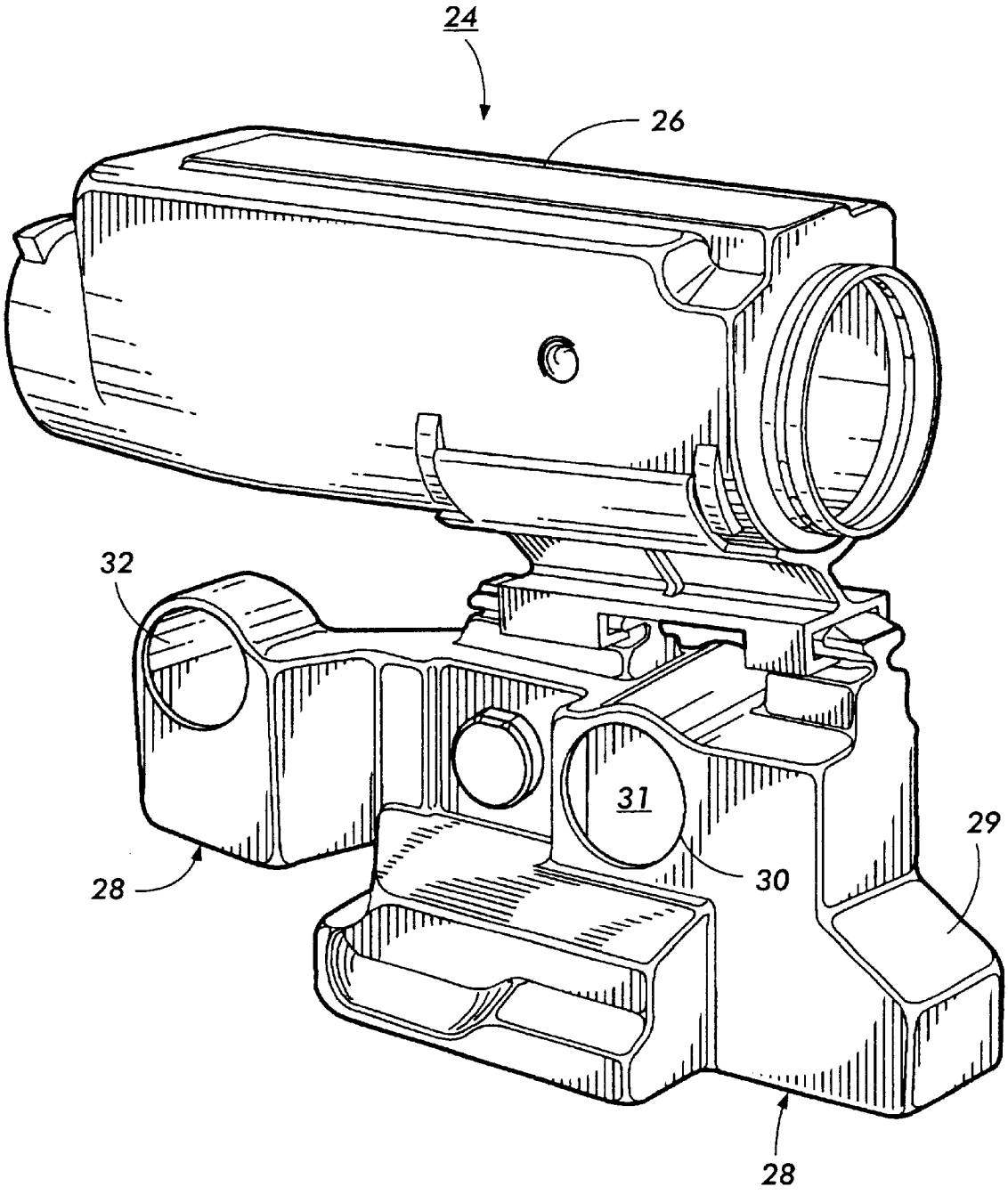
FIG. 2 is a perspective, schematic view of the developer material cartridge of the machine of FIG. 1 showing an open, unsealed waste sump opening.

Referring now to FIGS. 1–2, the basic elements of an electrostatographic reproduction machine, in this case a copier 10, and the developer material cartridge of the present invention are shown. As illustrated, the copier 10 includes an exposure means 12, which may include a lamp, a mirror, and a self-focusing lens arrangement for obtaining an exposure of an original image on a sheet 13 to be copied. The original image on sheet 13 is exposed onto the surface of a moving photoreceptor 14 (shown as a rotatable drum) which has been previously charged by means of a corotron device 16. When the charged surface of photoreceptor 14 is exposed to a light image of the original image on sheet 13, various portions of the surface will be discharged in imagewise fashion. Those areas of the photoreceptor 14 which were not discharged during such exposure, for example, can be the image areas, and are then developed with developer material by development unit 20, and in particular by a magnetic developer roll 34. Developer material may be single component comprising toner particles only, or it may dual component, comprising toner particles and carrier particles.

During development by the development unit 20, the toner particles of the developer material are caused to adhere to the image areas of photoreceptor 14, thus creating a visible or "developed" image of the original. This developed image is then moved, by the rotation of photoreceptor 14, to a transfer station 18, where the image forming toner on the photoreceptor is electrostatically transferred to a sheet of plain paper fed from a stack 21 of such sheets. After such image transfer, waste or residual toner particles remaining on the surface of the photoreceptor 14, are removed or cleaned off by a cleaning device 23, and transported for example by an auger (not shown) to the waste developer material sump portion of the cartridge of the present invention (to be described below). The sheet from stack 21 which receives the transferred toner image, is subsequently sent through a fuser 22, which causes the toner material to be melted and fused onto the sheet to form a permanent copy of the original image. The sheet is then moved to an output tray 25.

It is well known in the art to provide fresh developer material, such as that above, in a customer replaceable unit (CRU) or cartridge. In accordance with the present invention, a developer material cartridge or CRU, shown generally as 24 and containing fresh developer material, is provided for supplying such developer material to the development unit 20. The cartridge 24, for example can be of the type usable in a "trickle" development process. A conventional example of such a cartridge is disclosed in U.S. Pat. No. 5,428,436 issued Jun. 27, 1995. Trickle development as a process is discussed for example in Folkins et al., U.S. Pat. No. 4,614,165, the disclosure of which is incorporated herein by reference.

In summary however, it should be understood that in trickle development, there is provided a main supply of developer material containing both toner and carrier particles, which is drawn upon for application to an electrostatic latent image on photoreceptor 14. There is also provided a second supply of developer material, which gradually discharges, or trickles, into the main developer material supply. In most embodiments of trickle development, the main and secondary supplies of developer material have substantially different percentages of toner particles to carrier particles (also referred to herein as "TIC"). The main supply of developer material is retained in the development unit 20, while the secondary supply of developer material is discharged from a CRU or cartridge, such as 24, into the development unit 20. Simultaneously, in order to maintain both a relatively stable amount of developer material in the development unit 20, and also to maintain the TIC of the developer material in development unit 20 within an optimal range, a certain quantity of developer material is discharged as waste or used developer material from the development unit 20 into a waste sump portion of the CRU or cartridge 24.

Figure 3:
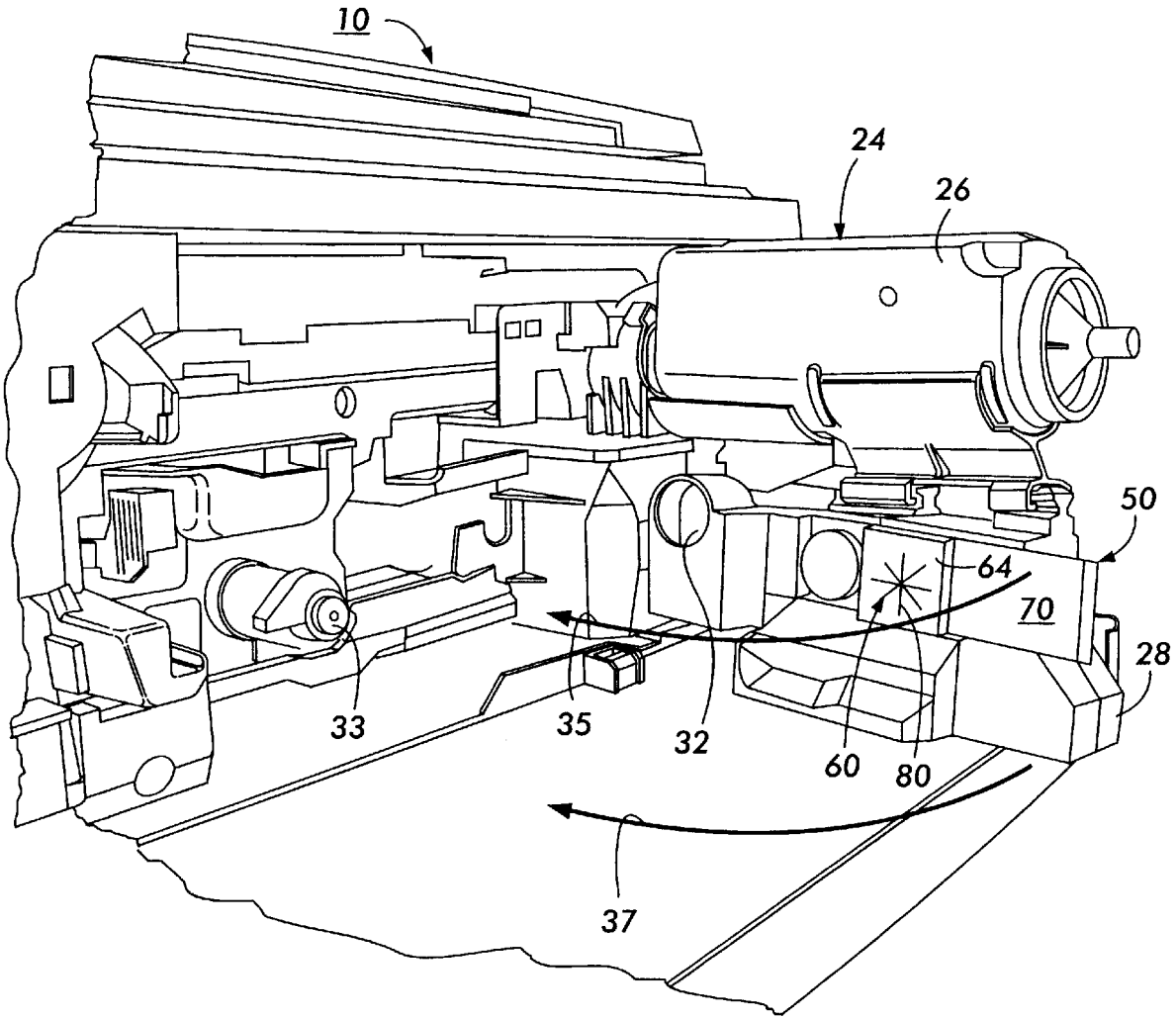
FIG. 3 is a perspective, schematic view of a portion of the machine of FIG. 1, showing the developer material cartridge assembled and in a pulled-out position, showing the non-interfering dual-use cartridge sealing device of the present invention in its first use of closing and presealing the waste sump opening of FIG. 2.

Still referring to FIGS. 1–3, there can be seen, interacting with development unit 20, the developer material cartridge 24 of the present invention. As further shown, the cartridge 24 includes a fresh developer material container 26, and a waste developer material container or waste sump 28. The waste sump 28 (FIG. 3) has 2 openings 30 and 32. In the copier or machine 10, a dispense or delivery auger 33 dribbles waste toner into the first sump opening 30,. A coupling member (not shown) couples the container 26 to the container or waste sump 28. In general, the container 26 which contains and supplies fresh developer material, can contain either toner particles only (single component case), or toner and carrier particles (dual component case). The waste sump or container 28 has a housing 29 that defines a waste chamber 31, and an opening 30 for receiving waste developer material into the chamber 31.

Still referring to FIGS. 2–3, and to FIG. 3 in particular, the cartridge 24 of the present invention is shown assembled into the machine 10, for example, and in a pulled out position. Specifically, FIG. 3 is a perspective, schematic view of a portion of the machine 10, showing the developer material cartridge 24 in the pulled-out position, and the non-interfering dual-use cartridge sealing device 50 of the present invention. The sealing device 50 is illustrated herein in its first use, which is that of closing and presealing the waste sump opening 30 of FIG. 2. Also shown in FIG. 3 is a waste developer material delivery auger 33 designed and positioned in the machine 10 for fitting into the waste sump opening 30 when the cartridge 24 is moved from its pull-out position (FIG. 3) into a pushed-in assembled position, FIG. 4. As shown in FIG. 3, the cartridge 24 is moved into the pushed-in position, by moving it in the direction of the arrows 35, 37.

Figure 5:
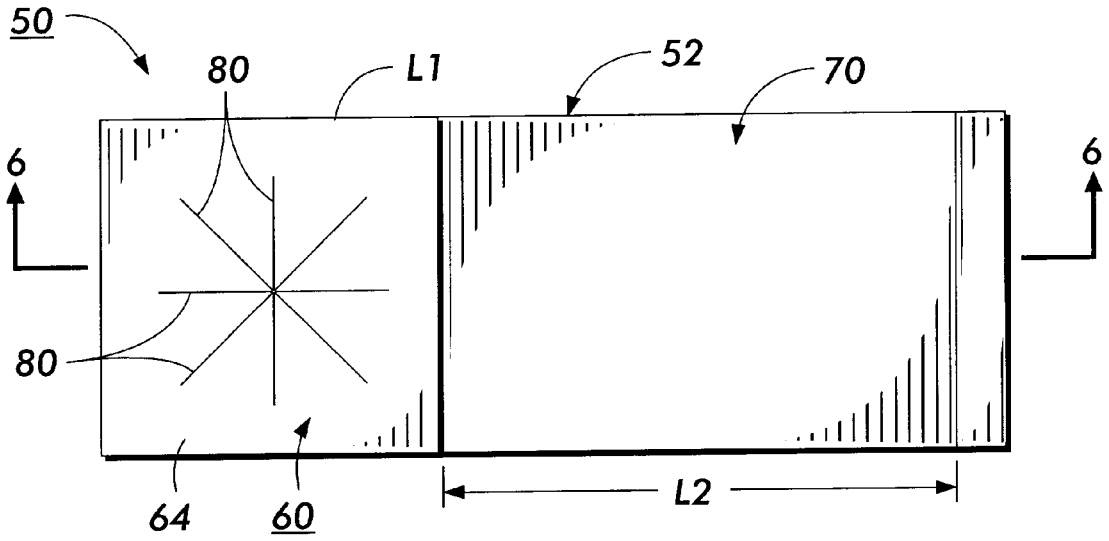
FIG. 5 is a front view of the non-interfering dual-use cartridge sealing device of the present invention.
Figure 6:
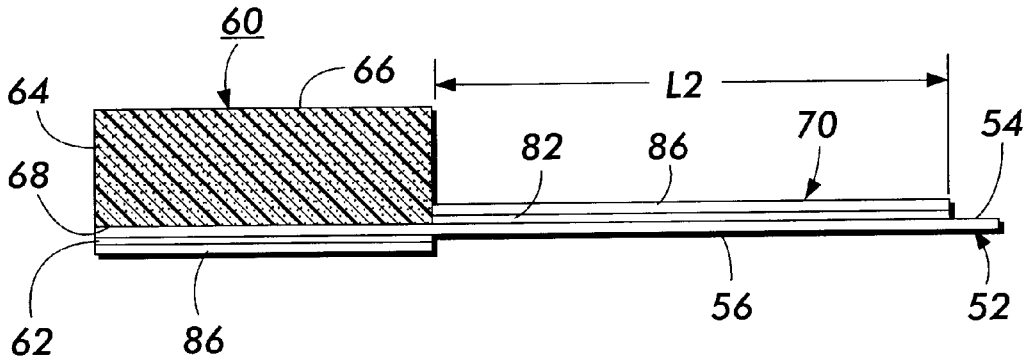
FIG. 6 is a side view (in section) of the non-interfering dual-use cartridge sealing device of FIG. 5.
Figure 7:
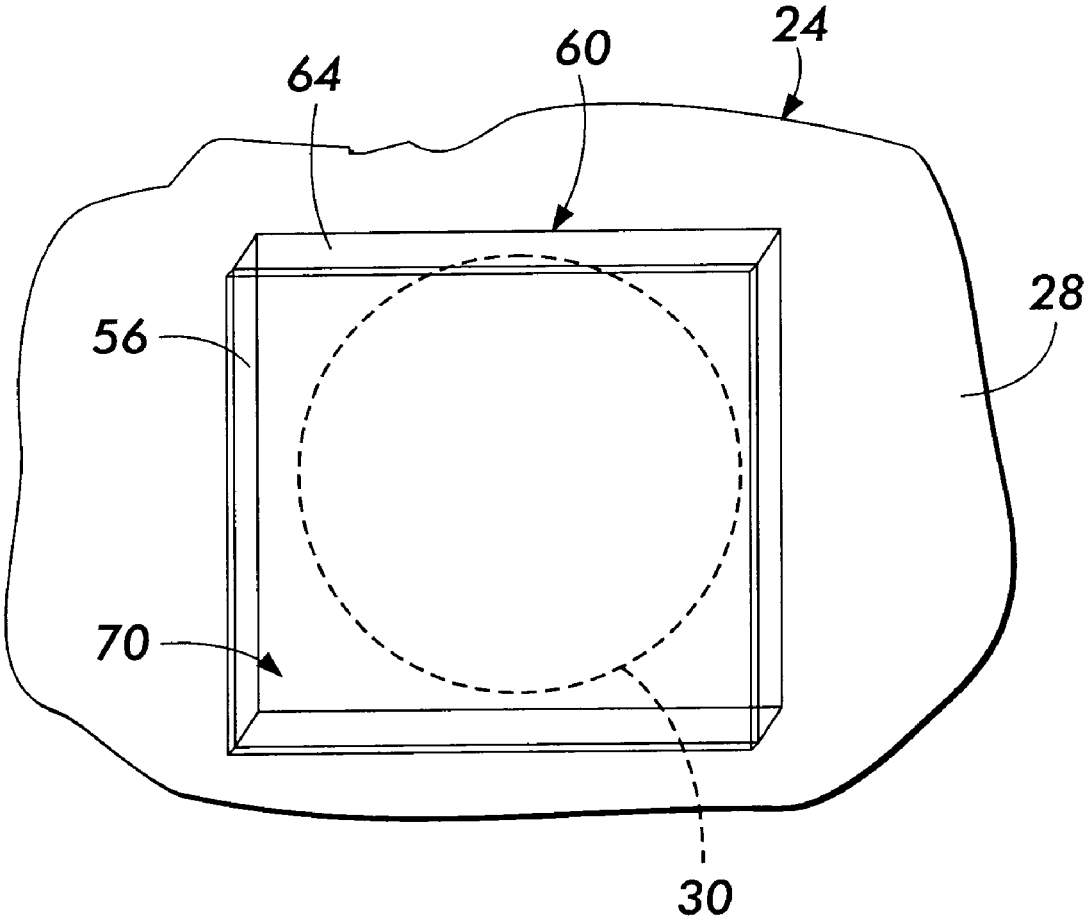
FIG. 7 is a schematic front view of a portion of the developer material cartridge of FIG. 3 removed from the machine, showing the non-interfering dual-use cartridge sealing device of the present invention in its second use of being folded over and resealing the waste sump opening against spillage during shipping.

Referring in particular to FIGS. 5–6, the dual function sealing device 50 of the present invention is illustrated in details, and is suitable in general for effectively accessibly sealing a particulate material receiving opening of a container during a particulate material receiving function of the container. It is also suitable for further resealing the accessibly-sealed opening during a shipping function of the container. As illustrated, the dual function sealing device 50 comprises an elongate substrate 52 having a first side 54, a second side 56, a first end 60 for mounting over the particulate material receiving opening such as 30 of the container (28) to provide an accessible seal, and a second end 70 for foldably mounting over the first end 60 for the resealing function as above.

The dual function device 50 also comprises a first adhesive layer 62 that is applied to the second side 56 at only the first end 60 of the elongate substrate 52, for adhering and mounting the second side 56 of the first end 60 to, and over the particulate or toner material receiving opening 30, as shown in FIG. 3. A resilient member 64, having a top side 66 and a bottom and opposite side 68, is attached to the first side 54 of the first end 60 so as to be directly over the particulate material receiving opening 30 when the sealing device 50 is mounted over the opening 30. As shown, the resilient member 64, and the first end 60 of the elongate substrate 52, each include multiple, centered and crossing slits 80 that are formed therethrough, from the top side 66 of the resilient member 64 through to the second side 56 of the first end. The slits 80 are suitable for enabling access by the auger 33 through the resilient member 64, and opening 30 into the chamber 31, (hence the resilient member and first end are considered as providing accessible sealing over the opening 30). Thus the slits 80 enable receiving of a particulate material delivery device such as the auger 33 into the opening 30 and yet also enables sealing against the auger and against particulate material leakage during particulate material delivery and receiving into the chamber 31.

Figure 4:
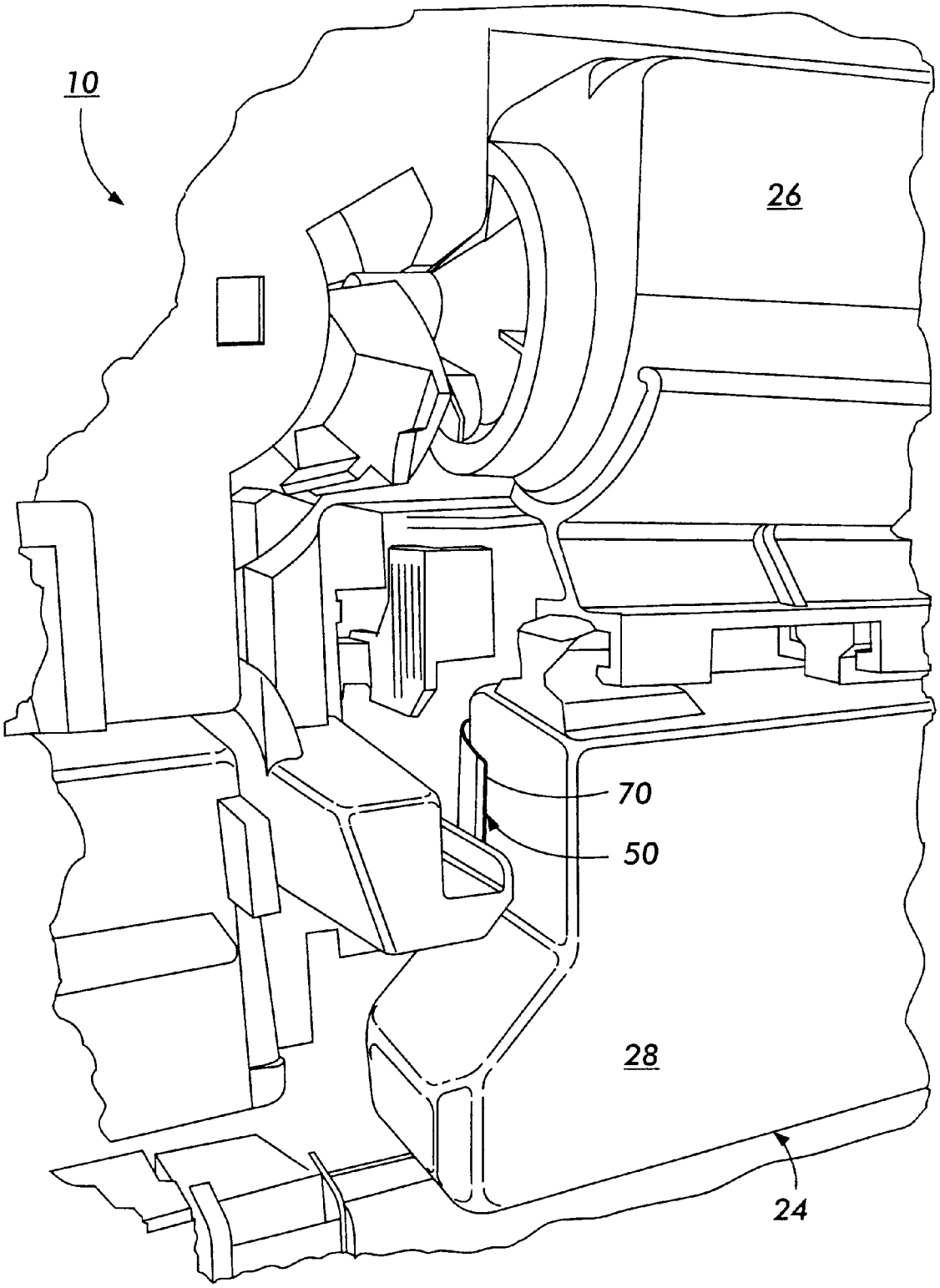
FIG. 4 is similar to FIG. 3 but with the developer material cartridge assembled and in a pushed-in position, and the non-interfering dual-use cartridge sealing device of the present invention tugged in a non-interfering manner between the developer material cartridge and a wall of the machine.

Importantly, the dual function sealing device 50 includes a second adhesive layer 82 that is applied to the first side 54 at the second end 70 of elongate substrate. As applied, the second adhesive layer 82 makes the first side 54 of the second end suitable for adhering and mounting onto the top side 66 of the resilient member 64, hence sealing the slits 80 and resealing against any access through the opening 30, and thus preventing particulate material leakage during shipping of the container, for example, the waste sump 28 containing received particulate material. The first adhesive layer 62, and the second adhesive layer 82 each include a removable cover 86 for protecting each adhesive layer until it is about to be used. The elongate substrate 52 is flexible in order to allow it to be flexed into a non-interfering position within the machine 10 as shown for example in FIG. 4. In particular, FIG. 4 is a perspective schematic of a portion of the machine, showing the developer material cartridge 24 assembled within the machine, and in a pushed-in position in which the auger 33 (FIG. 3) is inserted through the slits 80 (FIGS. 3, 5), into the chamber 31 for delivering waste developer material. The dual-use cartridge sealing device 50 must therefore be tugged in a non-interfering manner between the developer material cartridge 24, and a wall of the machine supporting the auger 33.

The dual function sealing device 50 may also include a short intermediate portion of the elongate substrate 52 between the first end 60 and the second end 70 that may or may not have and adhesive layer thereon. Such an intermediate portion will be foldable in order to locate the second end 70 into intimate and sealing contact over the first end 60. In order to provide good sealing coverage, the second end 70 therefore has a length L2 that is greater than a length L1 of the first end 60, that is when measured in a same direction. The fresh developer material container 26 may further comprise additional components (not labeled in this Figure) typically employed for developer cartridges including for example a mixing auger disposed within the chamber of the container 26.

In operation, a delivery tip of the auger 33 (FIG. 3) carrying waste toner or developer material is brought into contact with the top surface 66 of the resilient member 64, when the cartridge 24 is moved into the pushed-in position, FIG. 4. The auger 33 pushes against the top surface 66, causing the slits 80 to admit the auger which compresses the resilient material 64 inwardly as it pushes through both the resilient material and the flexible substrate 52, and through the opening 30 into the chamber 31. A discharge aperture (not labeled) in the auger 33 is positioned for delivering material into the chamber 31, when the auger is fully inserted into the waste sump 28. When the auger 33 is withdrawn from the chamber 31, and from the sealing device 50 (that is out of the substrate and resilient member), the resilient material 64 is supposed to spontaneously and immediately re-expand to reclose the slits 80 in an attempt to prevent waste developer material within the chamber 31 from spilling or leaking through the slits 80.

The present invention provides a cost effective seal device 50 for presealing and resealing the waste sump opening 30 of the waste sump container 28 of the developer material cartridge 24, thus making it possible to ship the cartridge 24 or waste sump 28 without waste developer material spilling or leaking. The sealing device 50 integrates the presealing and resealing features, and importantly eliminates the need to use extra repackaging containers such as bags. It also eliminates spillage from the waste sump into the extra container or bags, and hence the mess, handling problems and recycling complications that result from such spillage.

The customer or operator is instructed on how to seal each opening prior to shipping the cartridge or waste sump for reuse or recycling. Because the first opening 30 has a slitted seal member in the form of the first end 60 of the dual-function sealing device 50, waste toner within the sump will ordinarily tend to leak during shipping thereof to a recycling location. Fortunately in accordance with the present invention, the dual-function sealing device 50 enables easily cost effectively resealing the first opening 30 opening as above, thus preventing such spillage. Advantageously, the present invention integrates the presealing and resealing of the first opening 30. It also does so without physically interfering with the cartridge assembly or fit and operation in the machine 10. After the cartridge is removed from the machine, the operator peels off the paper backing, revealing the adhesive layer, and folds the extended second end 70 of the substrate member over the slitted resilient member 64 presealing the first opening 30, thereby preventing waste toner from leaking through the slits.

While the embodiment of the present invention disclosed herein is preferred, it will be appreciated from this teaching that various alternative, modifications, variations or improvements therein may be made by those skilled in the art, which are intended to be encompassed by the following claims:

What is being claimed is:

1. An electrostatographic reproduction machine comprising:

(a) a movable photoconductive member having an image bearing surface;

(b) means for forming a latent image electrostatically on said image bearing surface;

(c) developing means including toner particles for developing the latent image to be transferred onto a sheet;

(d) moving means for moving waste toner particles from said image bearing surface and from said developing means; and (e) a toner particle cartridge having a waste toner receiving opening for receiving waste toner particles from said moving means, and a non-interfering dual-use cartridge sealing device for accessibly presealing said receiving opening for receiving waste toner particles, and for effectively resealing said receiving opening during shipping of said toner particle cartridge to a recycling location, said non-interfering dual-use cartridge sealing device including a flexible substrate having a first portion and a second portion, said first portion having a resilient member mounted to said flexible substrate, slits formed through said resilient member and said flexible substrate in said first portion, and means for attaching said first portion over said receiving opening, and said second portion being foldable over said resilient member, and having means for effectively sealing said second portion to said resilient member, thus effectively resealing said receiving opening against waste toner particle spillage during shipping of said toner particle cartridge to a recycling location.

2. The electrostatographic reproduction machine of claim 1, wherein said moving means comprises a waste toner particle delivery auger for insertion through said slits of said first portion of said dual-use cartridge sealing device and through said receiving opening for delivering waste toner into said cartridge.

3. The electrostatographic reproduction machine of claim 1, wherein said toner particle cartridge comprises a fresh toner particle container and a waste toner particle container having said waste toner receiving opening.

4. In an electrostatographic reproduction machine for forming toner particles images, a toner particle cartridge comprising:

(a) cartridge housing defining a waste toner chamber;

(b) a waste toner receiving opening for receiving waste toner particles from a waste toner particle moving means into said chamber; and (c) a non-interfering dual-use cartridge sealing device for accessibly presealing said receiving opening against spillage when receiving waste toner particles into said chamber, and for effectively resealing said receiving opening during shipping of the toner particle cartridge to a recycling location, said non-interfering dual-use cartridge sealing device including:

(i) a flexible substrate having a first portion;

(ii) a resilient member mounted to said flexible substrate in said first portion;

(iii) slits formed through said resilient member and said flexible substrate in said first portion;

(iv) means for attaching said first portion over said receiving opening;

(v) a second portion being foldable over said resilient member of said first portion, and having means for effectively sealing against said resilient member, thus effectively resealing said slits through said resilient member and eliminating waste toner particle spillage during shipping of said toner particle cartridge to a recycling location.

5. The toner particle cartridge of claim 4, including a fresh toner particle container, and a waste toner particle container having said waste toner receiving opening.

6. The toner particle cartridge of claim 4, wherein a plurality of said slits crisscross and are centered relative to said first portion of said flexible substrate.

7. A dual function sealing device for effectively sealing a particulate material container during a particulate material receiving function of the container, and during a shipping function of the container containing received particulate material the sealing device comprising:

(a) an elongate substrate having a first side, a second side, a first end for mounting over a particulate material receiving opening of the container and a second end for mounting over said first end;

(b) a first end adhesive layer applied to said second side at only said first end of said elongate substrate for adhering said second side of said first end to and over the particulate material receiving opening of the container;

(c) a resilient member having a top side, and a bottom side attached to said first side of said first end so as to be over the particulate material receiving opening of the container when said dual function sealing device is attached to the container, said resilient member and said first end of said elongate substrate including multiple, centered and crossing slits formed from said top side through to said second side of said first end for receiving a particulate material delivery device therethrough into the opening of the container, and for sealing against particulate material leakage during particulate material delivery and receiving into the container; and (d) an adhesive layer applied to said first side at said second end of said elongate substrate for adhering said first side of said second end to said top side of said resilient member, thus sealing over said slits and preventing particulate material leakage during a shipping function of a container containing received particulate material.

8. The dual function sealing device of claim 7, wherein said first end adhesive layer and said second end adhesive layer each include a removable cover for protecting each adhesive layer.

9. The dual function sealing device of claim 7, wherein said elongate substrate is flexible.

10. The dual function sealing device of claim 7, including a short intermediate portion of said elongate substrate between said first end and said second end, said intermediate portion being foldable for locating said second end over said first end.

11. The dual function sealing device of claim 9, wherein said second end has a length greater than a length of said first end in a same direction for enabling said second end to be foldable and locatable evenly over said first end, thus sealing said first end.

* * * * *